US006425433B1

(12) United States Patent
Hayes

(10) Patent No.: US 6,425,433 B1
(45) Date of Patent: Jul. 30, 2002

(54) DIE CASTING VACUUM APPARATUS

(76) Inventor: John W. Hayes, 2095 Paris Cove, Hernando, MS (US) 38632

( * ) Notice: Subject to any disclaimer, the term of this patent is extended or adjusted under 35 U.S.C. 154(b) by 19 days.

(21) Appl. No.: 09/788,228

(22) Filed: Feb. 17, 2001

(51) Int. Cl.[7] ..... B22D 17/10

(52) U.S. Cl. ..... 164/305; 164/65; 164/113; 425/812

(58) Field of Search ..... 164/113, 312, 164/305, 65, 410; 425/420, 812

(56) References Cited

U.S. PATENT DOCUMENTS

| | | | | |
|---|---|---|---|---|
| 2,243,835 | A | 6/1941 | Brunner et al. | 22/73 |
| 2,415,462 | A | 2/1947 | Cherry et al. | 25/91 |
| 2,991,506 | A | 4/1961 | Crandall | 18/30 |
| 3,433,291 | A | 3/1969 | Hodler | 164/305 |
| 3,477,101 | A | 11/1969 | Fritsch | 18/30 |
| 3,804,570 | A | 4/1974 | Höschele et al. | 425/261 |
| 4,997,026 | A | 3/1991 | Ozeki et al. | 164/305 |
| 5,277,570 | A | 1/1994 | Siggers | 425/195 |

OTHER PUBLICATIONS

IMI Cash Valve, Inc., D–51, D–52 Vacuum Regulating or Breaker Valves (1997), p. 22.

*Primary Examiner*—Kuang Y. Lin
(74) *Attorney, Agent, or Firm*—Walker, McKenzie & Walker, PC

(57) ABSTRACT

An apparatus to inject molten material into and evacuate gasses from a mold cavity, including a pair of ganged pistons in communication with the mold cavity. An injection piston injects molten material into the cavity from the bottom, and a vacuum piston pulls a vacuum in the cavity from the top through a vacuum line. A filter in the vacuum line catches any material that escapes from the mold cavity. A vacuum regulator may selectively regulate the vacuum in the vacuum line. During the injection sequence's first phase, a vacuum is created at a rate proportional to the rate of injection. Part-way through the piston stroke, a second phase is entered and causes a vacuum break valve to open and control the amount of vacuum. The injection sequence has a step function velocity, with the second phase being at a much higher velocity than the first.

11 Claims, 3 Drawing Sheets

DIE CASTING VACUUM APPARATUS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to injection molding apparatus, and in particular, to means for evacuating gasses from the mold cavity of injection molding apparatus.

2. Information Disclosure Statement

The die casting process is well-known for making parts by injecting a specific amount of molten material into a mold cavity having a specific area and shape. The problem with the die-casting process is that any air trapped in the mold cavity during the injection process will cause voids or porosity in the molded part, thereby reducing the structural integrity of the final product.

Well known solutions to this problem include attaching a vacuum pump to the mold by means of a valving system as described in Ozeki, U.S. Pat. No. 4,997,026. The invention disclosed by Ozeki and other similar devices create a constant uncontrolled vacuum throughout the injection sequence and rely on a mechanical device, such as a valve, to control the repeated application of the vacuum. There are many shortcomings associated with this method of gas evacuation. One such problem occurs when the valve is opened too soon, causing the vacuum to draw the molten material into the mold cavity. If this happens and the material solidifies prior to completion of the injection sequence, the part produced will lack the required structural integrity. Another problem with the prior art is that the rate of evacuation of the vacuum-evacuated air is uncorrelated with the rate of injection of molten material injected into the mold cavity.

Still another problem exists in the prior art due to the lack of coordination between the operation of the vacuum breaking valve and the injection sequence. Over a period of time and after a large number of repetitions, molten material may be pulled into the mechanical workings of the valve and impede its performance unless the opening and closing of the valve is perfectly coordinated with the injection sequence.

It is therefore desirable to have an injection molding apparatus that controls the amount of vacuum present in the system and coordinates the operation of the valve with the steps in the injection sequence.

A preliminary patentability search in Class 425, subclasses 546, 812, and 420, produced the following patents, some of which may be relevant to the present invention: Siggers, U.S. Pat. No. 5,277,570, issued Jan. 11, 1994; Ozeki et al., U.S. Pat. No. 4,997,026, issued Mar. 5, 1991; Hoschele et al., U.S. Pat. No. 3,804,570, issued Apr. 16, 1974; Fritsch, U.S. Pat. No. 3,477,101, issued Nov. 11, 1969; Hodler, U.S. Pat. No. 3,433,291, issued Mar. 18, 1969; Crandall, U.S. Pat. No. 2,991,506, issued Jul. 11, 1961; Cherry et al. U.S. Pat. No. 2,415,462, issued Feb. 11, 1947; and Brunner et al., U.S. Pat. No. 2,243,835, issued Jun. 3, 1941.

None of these references, either singly or in combination, discloses or suggests the present invention.

BRIEF SUMMARY OF THE INVENTION

The present invention is a vacuum device for removing gas from the mold cavity of a injection molding apparatus such as a die-casting machine. Like the prior art, the invention has a mold consisting of first and second mold portions, and, when the first and second mold portions are pressed together, they form the mold cavity where the molded part is formed. Different from the prior art, the rate of gas evacuation from the mold cavity is directly proportional to the rate of injection of molten material into the mold cavity, accomplished by a pair of ganged pistons, both in communication with the interior of the mold cavity, that are linked together for simultaneous operation. One of the ganged pistons is an injection piston that injects molten material from an injection piston cylinder into the mold cavity. The other of the ganged pistons is a vacuum piston that pulls a vacuum in the mold cavity to eliminate gases which, if present, would cause porosity of the final product. This vacuum is created through a vacuum line that is connected on one end to the mold cavity and on the other end to the vacuum cylinder. The vacuum line contains a filter interposed between the mold and the vacuum cylinder to prevent any molten material that has escaped into the vacuum lines from going into the valve of the regulator and clogging the valve mechanism.

The injection sequence is divided into two phases. During the first phase, the injection and vacuum pistons concurrently move at a slow pace with the injection piston of the injection cylinder slowly moving the molten material toward the mold cavity and with the ganged vacuum piston pulling a vacuum in the mold cavity at a rate proportional to the reciprocation speed of the injection piston. When the ganged pistons pass a certain point in their stroke, an electrical signal from the die-casting apparatus triggers the high-velocity second phase of the injection sequence. During this second phase, both the injection and vacuum pistons move at a high rate of speed with the injection piston rapidly forcing the molten material into the mold cavity. The electrical signal that triggers the second phase also opens a vacuum break in the vacuum cylinder. The vacuum break has a diaphragm that can be adjusted to control the amount of vacuum in the vacuum line, thus allowing a pre-selected constant vacuum during the second phase of the injection sequence.

It is an object of the present invention to provide a gas-evacuating device that, during the first stage of injection, develops a vacuum at a rate proportional to the rate molten material is injected into the mold cavity.

It is a further object of the invention to provide such a device that requires no additional energy for operation over already existing devices.

It is an object of the invention to provide a vacuum device with very few moving parts, none of which come into contact with the molten material, thereby decreasing repair time and increasing efficiency.

DETAILED DESCRIPTION OF THE INVENTION

Figure 1:
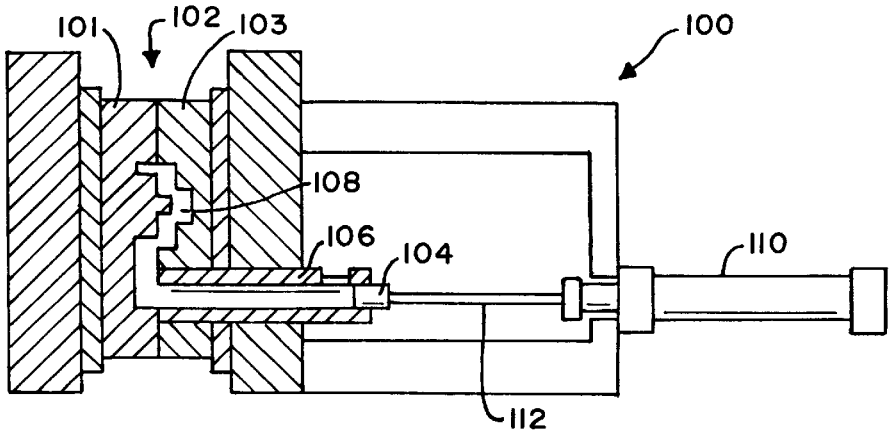
FIG. 1 (Prior Art)
FIG. 1 is a side sectional view of the prior art showing a well-known die-casting machine.

FIG. 1 shows a side sectional view of a well-known prior art injection-molding apparatus 100 comprising a mold portion 102 and an injection piston 104. Mold portion 102 is comprised of a left mold portion 101 and a right mold portion 103. Injection piston 104 is mounted for reciprocation within an injection cylinder 106, and a mold cavity 108 is formed by the walls of mold portion 102 when left mold portion 101 and right mold portion 103 are brought together. A well-known hydraulic cylinder-and-piston forcing means 110, operably coupled to injection piston 104 as by a mechanical linkage 112, causes injection piston 104 to reciprocate within injection cylinder 106 in a manner well-known to those skilled in the art. Such devices as injection molding apparatus 100 are well-known for making a molded part to a desired specification by forcing a specific amount of molten material from injection cylinder 106 by injection piston 104 into a mold cavity 108 of the specific and desired size and shape of the molded part. A well-known vacuum pump, not shown but in communication with the interior of mold cavity 108, is often used in conjunction with the prior art device to evacuate gasses from mold cavity 108.

Referring to FIGS. 2–5, the die-casting vacuum apparatus 20 of the present invention is seen to comprise an injection piston 22 mounted for reciprocation within an injection cylinder 24, and a vacuum piston 26 mounted for reciprocation within a vacuum cylinder 28. A mold cavity 30, of a desired size and shape, is provided for forming a molded part therewithin of said desired size and shape, and a vacuum line 32 is provided that causes mold cavity 30 to be in communication with vacuum cylinder 24. Injection piston 22 is in communication with mold cavity 30 and, as injection piston 22 reciprocates into injection cylinder 24, injection piston 22 forces molten material 34 within injection cylinder 24 into mold cavity 30. Prior to initiation of the molding process for each part, molten material 34, preferably molten metal, is poured into apparatus 20 through an opening 36 in the top of injection cylinder 24. Typically, and preferably, about 30% more molten material 34 than needed for the finished molded part is poured into opening 36 of injection cylinder 24 to compensate for overflow, etc., during the molding process. Vacuum piston 26 is mounted for reciprocation within vacuum cylinder 28 so that, as vacuum piston 28 reciprocates out of vacuum cylinder 28, air is evacuated from within mold cavity 30 through vacuum line 32. Vacuum line 32 preferably includes well-known filter means 38 interposed between mold cavity 30 and vacuum piston 26 for trapping and catching any molten material 34 that escapes from mold cavity 30 into vacuum line 32.

Injection piston 22 is caused to reciprocate into and out of injection cylinder 24 by forcing means 40 such as, for example, a well-known hydraulic cylinder-and-piston that includes a driven piston 42 that reciprocates within a hydraulic cylinder 44 in a manner well-known to those skilled in the art using a well-known source of hydraulic pressure 46 supplied to and from hydraulic cylinder 44 through well-known bidirectional valves 48, 50 interposed within supply lines 52, 54, and with valves 48 and 50 being respectively controlled using control signals 56, 58 supplied by control means 60, hereinafter discussed.

Apparatus 20 further includes ganging means 62 for coupling injection piston 22 to vacuum piston 26, thereby creating simultaneous coordinated movement of the two pistons. Ganging means 62 is preferably a mechanical linkage or coupling such as, for example, an arm 64 directly coupling injection piston 22 to vacuum piston 26. As the injection piston 22 reciprocates into the injection cylinder 24, the vacuum piston 26 concurrently caused to reciprocate out of vacuum cylinder 28 at the same rate of speed.

Figure 2:
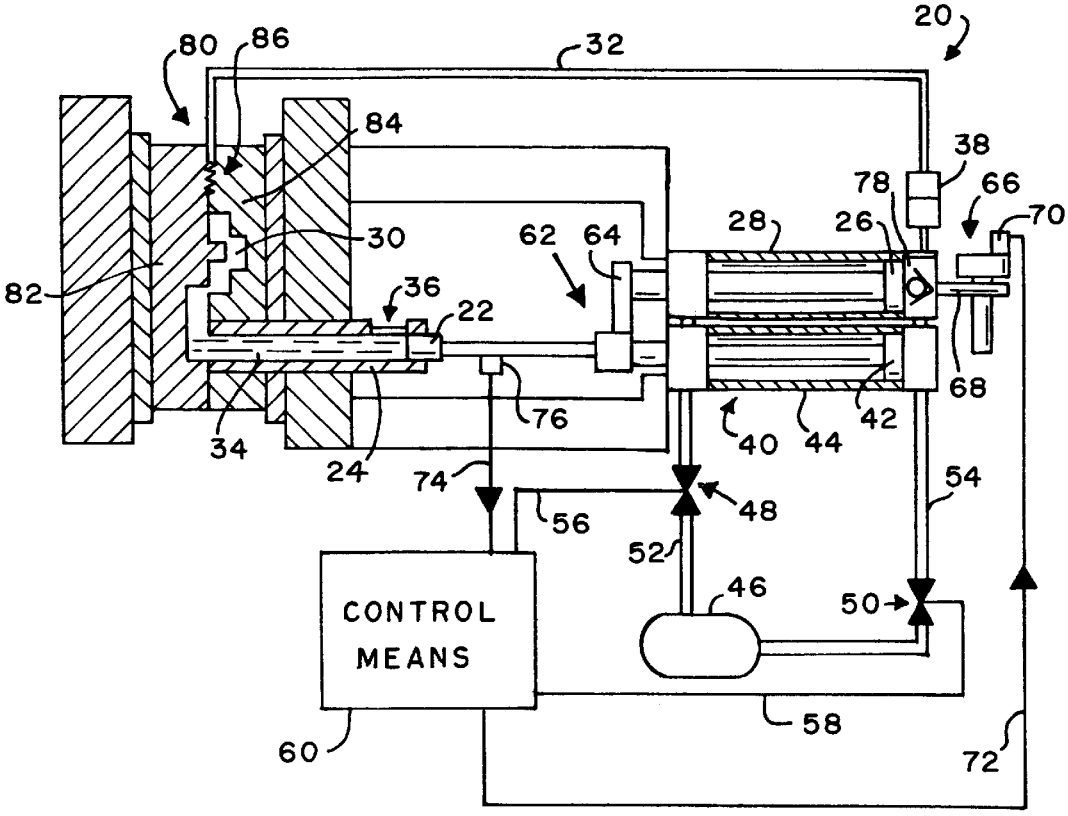
FIG. 2 is a side sectional view of the present invention showing the apparatus with the pistons in the starting position of the first phase of the injection sequence.
Figure 3:
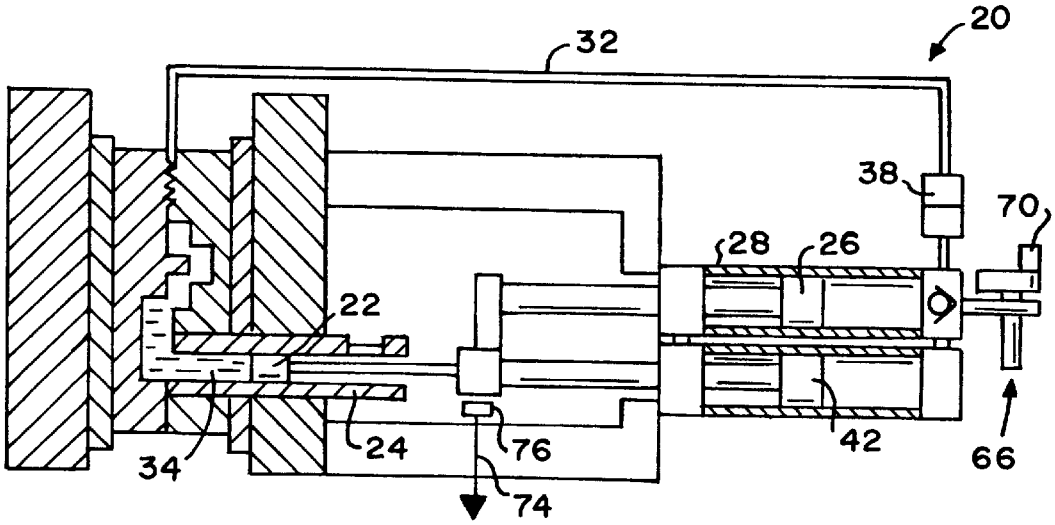
FIG. 3 is a side sectional view of the present invention showing the apparatus at the beginning of the second phase of the injection sequence.
Figure 4:
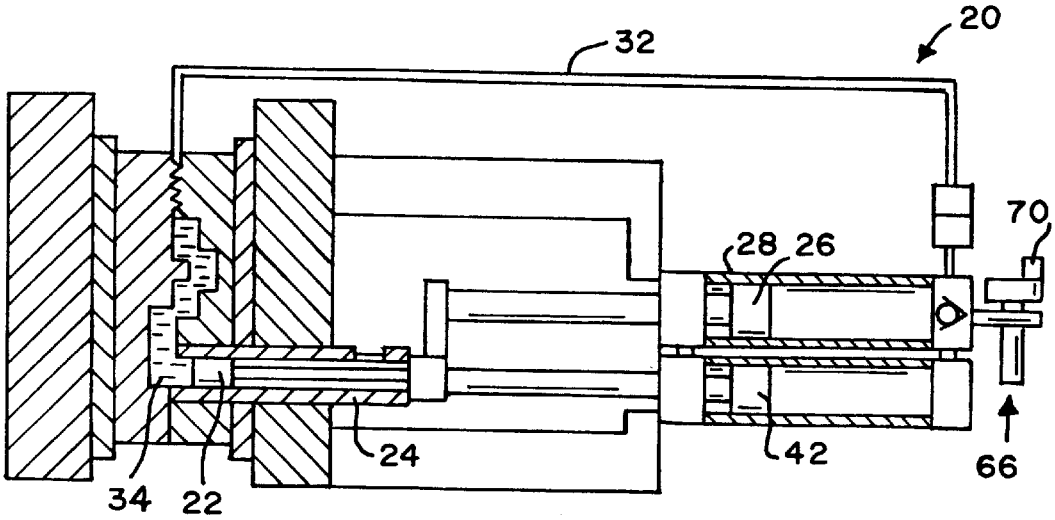
FIG. 4 is a side sectional view of the present invention showing the apparatus at the end of the injection sequence.
Figure 6:
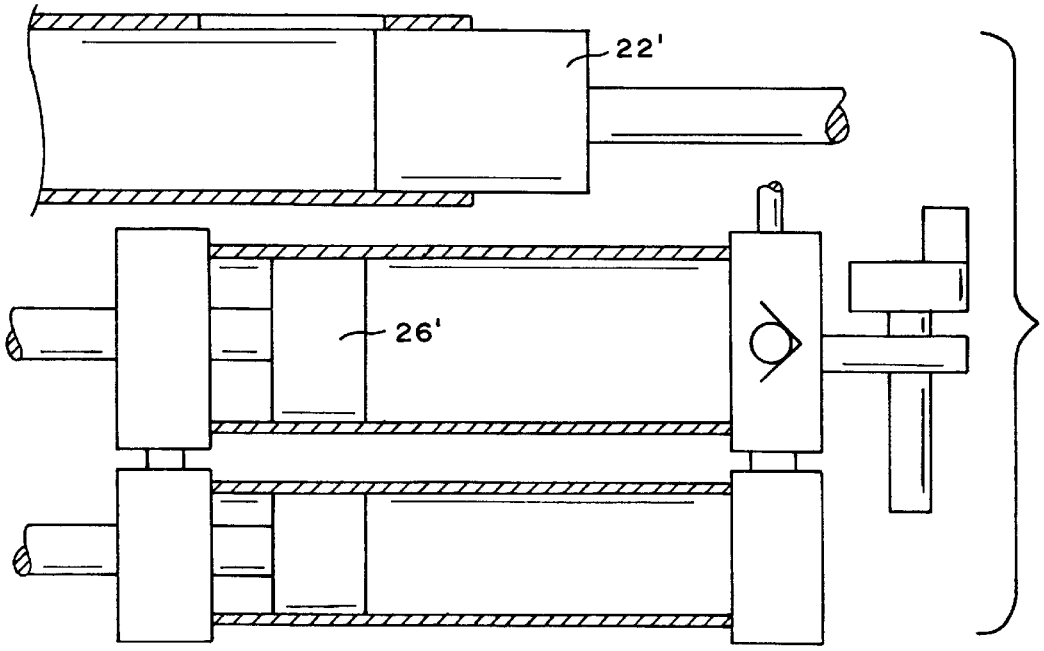
FIG. 6 is a side sectional view of a portion of a modified version of the present invention in which the cross-sectional area of one of the ganged pistons is different from the cross-sectional area of the other of the ganged pistons.

It should be understood that, because vacuum piston 26 is directly coupled to the injection piston 22, the vacuum created within vacuum line 32, and thus the rate of gas evacuation from the mold cavity 30, by vacuum piston 26 is directly proportional to the rate of injection of molten material into the mold cavity by injection piston 22, and it will be understood that the rate of injection of molten material into the mold cavity is necessarily proportional to the stroke velocity of injection piston 22. If injection piston 22 and vacuum piston 26 have the same transverse cross-sectional area, and if ganging means 62 is a direct one-to-one mechanical linkage as shown in the drawings, then the constant of proportionality will simply be the ratio of the two transverse cross-sectional areas of the two pistons. FIG. 6 shows an alternate embodiment of the invention in which the transverse cross-sectional area of vacuum piston 26' is substantially the same as the transverse cross-sectional area of injection piston 22', in which case the rate of gas evacuation from the mold cavity will be the same as the injection rate of molten material into the mold cavity. In contrast, and to show the different ways in which the invention may be configured, FIGS. 2–4 show an embodiment of the invention in which the transverse cross-sectional area of the vacuum piston 26 is larger than the transverse cross-sectional area of injection piston 22, thereby causing the rate of gas evacuation from the mold cavity to be greater than the injection rate of molten material into the mold cavity by the ratio of the transverse cross-sectional areas of the two pistons. Similarly, if ganging means 62 were not a one-to-one coupling, but instead employed gears or levers or the like to cause the stroke velocity of the vacuum piston to be a multiplier constant (greater or lesser than 1.0) times the stroke velocity of the injection piston, then the rate of gas evacuation from the mold cavity would be understood to be this multiplier constant times the injection rate of molten material times the ratio of the transverse cross-sectional areas of the two pistons.

Apparatus 20 preferably includes regulating means 66 for selectively regulating the vacuum within vacuum line 32 to mold cavity 30. Regulating means 66 preferably includes a well-known vacuum break valve 68 having a mechanically-operated adjustable diaphragm that is actuated by an electrical solenoid 70, with solenoid 70 being controlled by electrical signal 72 from control means 60, hereinafter described, and with vacuum break valve 68 being interposed between vacuum line 32 and the atmosphere. An example of an acceptable vacuum break valve 68 is the model D-52 vacuum breaker sold by IMI Cash Valve Inc., located in Cullman, Ala. When vacuum break valve 68 is not actuated, it does not modify the vacuum within vacuum line 32 because the diaphragm within vacuum break valve 68 is closed. When vacuum break valve 68 is actuated by solenoid 70 under the direction of control means 60, the diaphragm within vacuum break valve 68 opens to the atmosphere, causing the vacuum within vacuum line 32 to become a preselected constant vacuum that may be adjusted by adjusting the degree to which the diaphragm within vacuum break valve 68 opens to the atmosphere, thereby pre-selecting the amount of atmospheric pressure passed when the vacuum break valve is actuated.

The injection sequence is divided into two phases, a first portion and a second portion. During the first portion of the injection sequence, injection piston 22 moves at a first velocity, vacuum break valve 68 is not actuated (i.e., is closed), and the vacuum in the vacuum line 32 is thus proportional to the first velocity, as heretofore described. During the second portion of the injection sequence, injection piston 22 moves at a second velocity, which is preferably much faster than the first velocity, vacuum break valve 68 is actuated (opened) by electrical signal 72, and the vacuum in the vacuum line 32 is caused to be a preselected constant vacuum that may be adjusted by adjusting the diaphragm of vacuum break valve 68.

Apparatus 20 includes control means 60 for selectively switching regulating means 66 from a first mode, when injection piston 22 is in its first portion of movement, to a second mode when injection piston 22 is in its second portion of movement. When regulating means 66 is in the first mode, the vacuum break valve 68 is in a closed position thus preventing atmospheric pressure from entering the vacuum line 32 during the first portion of the injection sequence. When regulating means is in the second mode, the vacuum break valve 68 is open, thus allowing some atmospheric pressure to enter the vacuum line 32 and thereby creating a preselected constant vacuum in the vacuum line 32 during the second portion of the injection sequence. The preselected constant vacuum has been found to preferably be 15 to 25 inches (381 to 635 mm) of mercury, depending on the size of the part being molded. Control means 60 receives an electrical triggering input signal 74 from a detector 76, such as a well-known proximity switch, located adjacent the rod 50 of injection piston 22. Control means 60 receives electrical triggering signal 74 from the detector 76 when injection piston 22 has reached the end of the first portion of the injection sequence, as shown in FIG. 3. This signal causes the second portion of the injection sequence to be initiated, and injection piston 22 is caused to quickly accelerate to the second velocity by fully-opening bi-directional valves 48, 50. The operator of the apparatus 20, when setting up the apparatus for molding a new part, adjusts the position of the detector 76 so that the electrical triggering input signal 74 is generated for control means 60 at the point where the molten material 34 just reaches the bottom of the mold cavity 30, just prior to beginning to fill that portion of the void of the mold cavity that will become the molded part, so that the injection piston moves at the second velocity during the time when molten material is filling that portion of the mold cavity 30 that will become the molded part. The velocity curve of the injection sequence is preferably a step function, having a first constant velocity during the first portion of the injection sequence and an almost-immediate increase to the second velocity during the second portion of the injection sequence. At the same time that control means 60 receives the triggering signal 74 from detector 76 that causes initiation of the second phase of the injection sequence, control means 60 emits electrical signal 72 to regulating means 66 that causes regulating means 66 to switch from its first mode to the second mode. The opening of the vacuum break valve 68 of regulating means 66 allows some atmospheric pressure to pass through the diaphragm of regulating means 66 as described hereinabove, thereby creating a preselected constant controlled vacuum in the vacuum line (rather than the vacuum of the first mode, in which the vacuum is proportional to the first velocity of the injection piston). This preselected constant controlled vacuum is maintained during the second phase of the sequence while the molten material 34 is rapidly injected into the mold cavity 30. The entire second portion of the injection sequence lasts approximately 0.5 to 1.0 seconds and the vacuum break valve 68 must be controlled with a high degree of precision for accurately timed opening and closing during repeated operation over many cycles. When the second portion of the injection sequence is complete, as shown in FIG. 4, the vacuum break valve 68 is again placed in its closed position, and injection piston 22 and vacuum piston 26 begin their return strokes to their original starting positions as shown in FIG. 2. Any air trapped in vacuum cylinder 28 at the end of the forward stroke is released on the return stroke through a one-way check valve 78 located in the vacuum cylinder 28. As it cools, the molten material 34 solidifies in the mold cavity 30, thereby forming the desired molded part.

Figure 5:
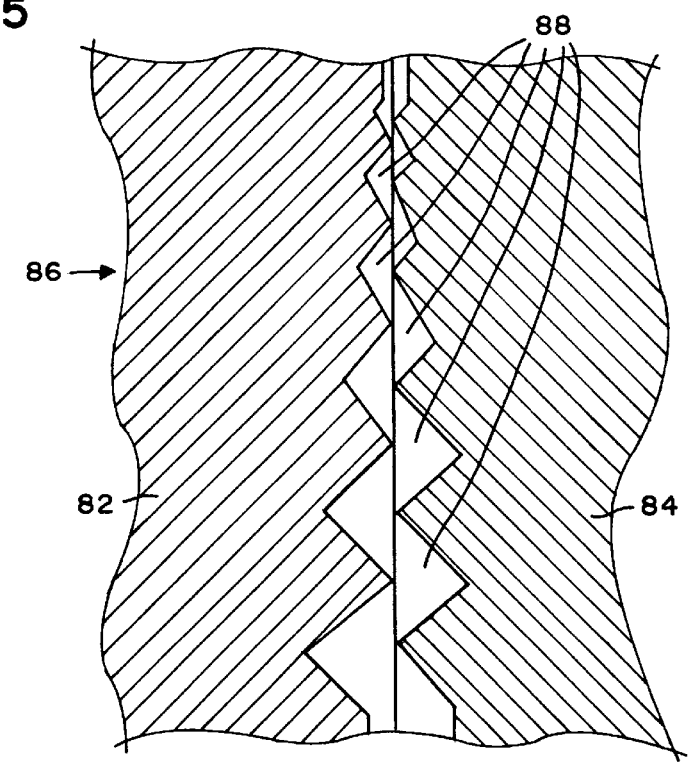
FIG. 5 is a side sectional view of the chill block of the present invention.

Apparatus 20 may be used in combination with a mold 80 comprised of a first mold portion 82, a second mold portion 84, and a mold cavity 30 that is formed when the first mold portion 82 and second mold portion 84 are brought together. The mold 80 also has a well-known chill block 86 interposed between mold cavity 30 and vacuum line 32 where overflow of excess molten material 34 is forced during the second portion of the injection sequence. As best seen in FIG. 5, the chill block 86 is formed by a sequence of mating channel portions 88 in the first mold portion 82 and second mold portion 84. When the first mold portion 82 and the second mold portion 84 are brought together, the channel portions 88 of the chill block 86 form a serpentine path through which the vented gasses and vaporized molten material 34 pass. The area of each channel portion 88 decreases as it approaches the vacuum line 32. The purpose of the chill block 86 is to cool the excess molten material 34 before it reaches the vacuum line 32. However, any molten material 34 that escapes into the vacuum line 32 will be trapped by filter means 38 before reaching the interior of the vacuum break valve 68.

The apparatus 20 has a minimum of moving parts, and only the moving injection piston is in contact with the molten material. This factor eliminates so-called "down time" during production and, as a result, the present invention increases production efficiency as compared with the prior art. It is well-known that prior art die-casting apparatus require a large amount of energy for operation, approximately 50% of which is used to produce the desired molded part or component. In comparison to the amount of energy already used by prior art die-casting apparatus 100, the additional energy required for operation of vacuum cylinder 28 of the present invention is negligible. Thus, the present invention requires relatively no additional energy consumption.

Although the present invention has been described and illustrated with respect to a preferred embodiment and a preferred use therefor, it is not to be so limited since modifications and changes can be made therein which are within the full intended scope of the invention.

I claim:

1. An apparatus for injecting molten material into a mold cavity while venting said mold cavity, said apparatus comprising:

(a) an injection piston in communication with said mold cavity and mounted for reciprocation within an injection cylinder so that, as said injection piston reciprocates within said injection cylinder, molten material within said injection cylinder is forced into said mold cavity;

(b) a vacuum cylinder;

(c) a vacuum line causing said mold cavity to be in communication with said vacuum cylinder;

(d) a vacuum piston being mounted for reciprocation within said vacuum cylinder so that, as said vacuum piston reciprocates within said vacuum cylinder, air is evacuated through said vacuum line from within said mold cavity; and (e) ganging means for coupling said vacuum piston and said injection piston for simultaneous coordinated movement so that, as said injection piston reciprocates into said injection cylinder, said vacuum piston is caused to reciprocate out of said vacuum cylinder.

2. The apparatus as recited in claim 1, in which said vacuum line includes filter means, interposed between said mold cavity and said vacuum cylinder, for trapping molten material that escapes into said vacuum line from said mold cavity.

3. The apparatus as recited in claim 1, in which said ganging means is a mechanical doupling of said injection piston to said vacuum piston.

4. The apparatus as recited in claim 1, in which said apparatus further comprises regulating means for regulating the amount of vacuum present in said vacuum line.

5. The apparatus as recited in claim 4, in which said injection piston moves at a first velocity for a first portion of its movement and moves at a second velocity for a second portion of its movement, and said apparatus includes control means for selectively switching said regulating means from a first mode to a second mode, said regulating means being placed in said first mode when said injection piston is in said first portion of its movement and said regulating means being placed-in said second mode when said injection piston is in said second portion of its movement; said regulating means being adapted so that, when in said first mode, the vacuum in said vacuum line is proportional to said first velocity of said injection piston and so that, when in said second mode, the vacuum in said vacuum line is a preselected constant vacuum.

6. In combination:

(a) a mold, said mold comprising a first mold portion and a second mold portion, said mold having a mold cavity formed between said first and second mold portions when said first and second mold portions are brought together; and (b) an apparatus for injecting molten material into said mold cavity while venting said mold cavity, said apparatus comprising:

i. an injection piston in communication with said mold cavity and mounted for reciprocation within an injection cylinder so that, as said injection piston reciprocates within said injection cylinder, molten material within said injection cylinder is forced into said mold cavity, ii. a vacuum cylinder;

iii. a vacuum line causing said mold cavity to be in communication with said vacuum cylinder;

iv. a vacuum piston being mounted for reciprocation within said vacuum cylinder so that, as said vacuum piston reciprocates within said vacuum cylinder, air is evacuated through said vacuum line from within said mold cavity; and v. ganging means for coupling said vacuum piston and said injection piston for simultaneous coordinated movement so that, as said injection piston reciprocates into said injection cylinder, said vacuum piston is caused to reciprocate out of said vacuum cylinder.

7. The combination as recited in claim 6, in which said mold further has a chill block formed therewithin for cooling molten material escaping from said mold cavity, said chill block being interposed between said mold cavity and said vacuum line.

8. The combination as recited in claim 6, in which said vacuum line includes filter means, interposed between said mold cavity and said vacuum piston, for trapping molten material escaping into said vacuum line from said mold cavity.

9. The combination as recited in claim 6, in which said ganging means is a mechanical cowpling of said injection piston to said vacuum piston.

10. The combination as recited in claim 6 in which said apparatus further comprises regulating mieans for regulating the amount of vacuum present in said vacuum line.

11. The combination as recited in claim 10, in which said injection piston moves at a first velocity for a first portion of its movement and moves at a second velocity for a second portion of its movement, and said apparatus includes control means for selectively switching said regulatipg means from a first mode to a second mode, said regulating means being placed in said first mode when said injection piston is in said first portion of its movement and said regulating means being placed in said second mode when said injection piston is in said second portion of its movement; said regulating means being adapted so that, when in said first mode, the vacuum in said vacuum line is proportional to said first velocity of said injection piston and so that, when in said second mode, the vacuum in said vacuum line is a preselected constant vacuum.

* * * * *